United States Patent [19]

Geise

[11] Patent Number: 4,689,920

[45] Date of Patent: Sep. 1, 1987

[54] SLITTING TOOL

[75] Inventor: Samuel C. Geise, Memphis, Tenn.

[73] Assignee: Specialty Tool Co., Inc., Memphis, Tenn.

[21] Appl. No.: 897,724

[22] Filed: Aug. 18, 1986

[51] Int. Cl.[4] ..... B24B 19/00

[52] U.S. Cl. ..... 51/241 S; 29/402.07; 409/175

[58] Field of Search ..... 51/241 R, 241 S, 47, 51/33 R; 125/13 R; 29/157.4, 402.06, 402.07; 409/175, 191, 212

[56] References Cited

U.S. PATENT DOCUMENTS 1,442,381 1/1923 Bole ..... 51/47

2,109,827 3/1938 Moffett ..... 51/241 S

*Primary Examiner*—Roscoe V. Parker

*Attorney, Agent, or Firm*—Walker & McKenzie

[57] ABSTRACT

A tool for cutting a slit into the ends of one or more web portions of a membrane wall. A guide bar is secured above the web portions. An arm member is swingably attached to the guide bar. A cutting unit is attached to the distal end of the arm member for engaging and cutting a slit into a web portion of the membrane wall when the arm member is swung between first and second positions.

7 Claims, 6 Drawing Figures

SLITTING TOOL

BACKGROUND OF THE INVENTION

1. Field of the Invention

The present invention relates to the repair of boiler tubes in steam plants and the like, and more specifically to a tool for cutting a slit in the web portion of membrane walls.

2. Description of the Related Art

Most steam plants and the like include a plurality of substantially vertical boiler tubes joined to one another by web portions. The boiler tubes/web portions assembly are referred to as a membrane wall. The membrane wall may be over 100 feet in height and length. It often becomes necessary to replace a section of membrane wall. In such a case, the section of membrane wall to be replaced is cut from the remainder of the membrane wall using a cutting torch or the like and a new section welded in place. However, prior to welding the new section of membrane wall in place, the distal ends of the remaining boiler tubes must be prepared for welding. In order to properly prepare the ends of the remaining boiler tubes for welding and/or to provide room for welding, slits are normally cut into the ends of the web portions adjacent the ends of the remaining tubes. The normal method is to utilize a cutting torch to cut slits into the web portions adjacent the ends of the remaining boiler tubes. Such a method necessitates the "cleaning" of the membrane wall utilizing files, portable grinders and the like after the slits are cut into the web portions.

SUMMARY OF THE INVENTION

The present invention is directed toward providing a portable tool that can be secured adjacent the end of one or more web portions of a membrane wall and that can be used to accurately, quickly and easily cut a slit into the ends of the one or more web portions.

The tool of the present invention comprises, in general, a guide bar; securing means for securing the guide bar to a membrane wall at a location above one end portion of the membrane wall; a swing arm having a first end attached to the guide bar and having a second end swingable between a first position and a second position; and cutting means attached to the second end of the swing arm for cutting a slit into at least one web portion of the membrane wall when the swing arm is moved between the first and second positions.

DESCRIPTION OF THE PREFERRED EMBODIMENT

Figure 1:
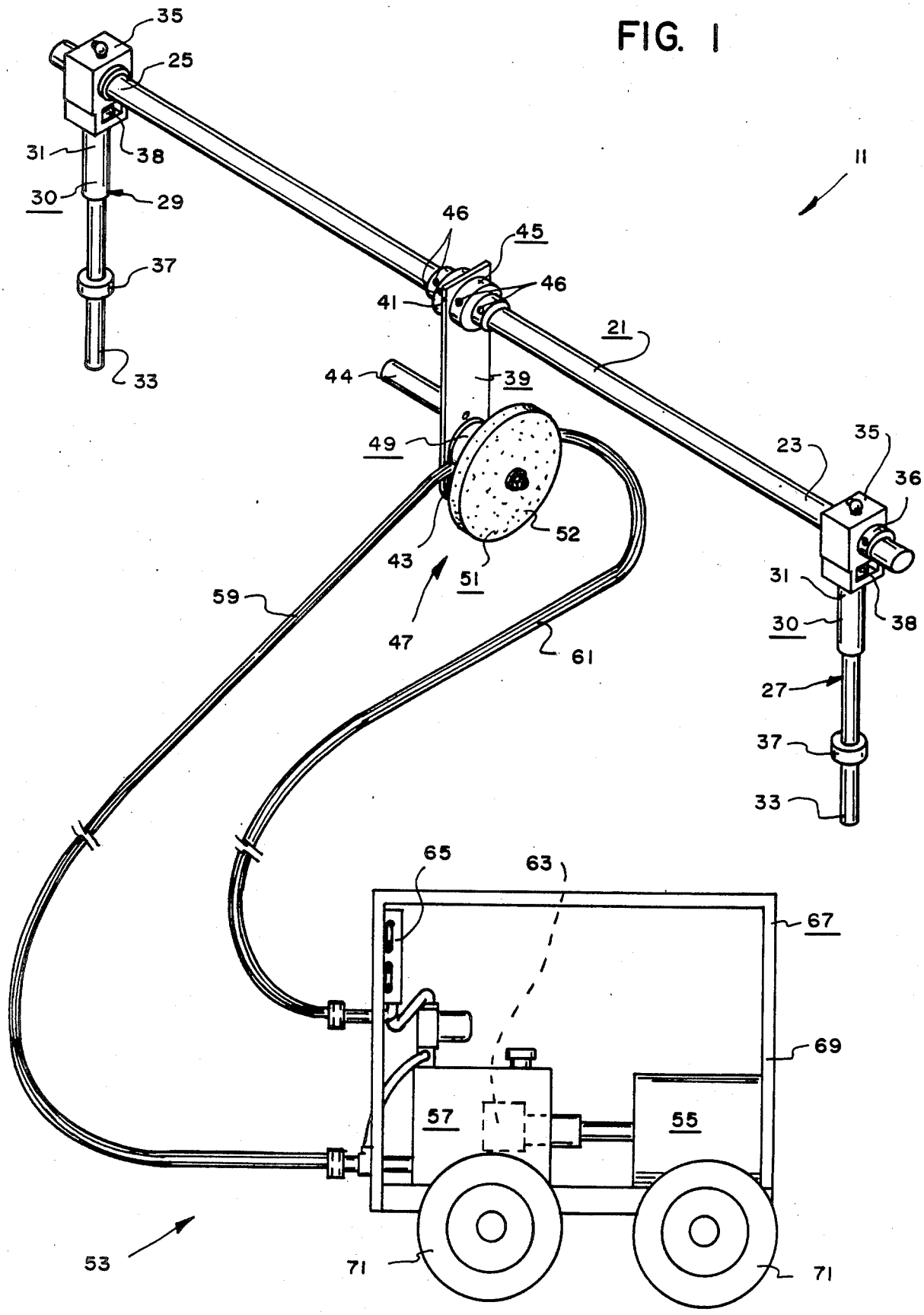
FIG. 1 is a somewhat diagrammatic view of the slitting tool of the present invention showing a portion thereof in perspective.
Figure 2:
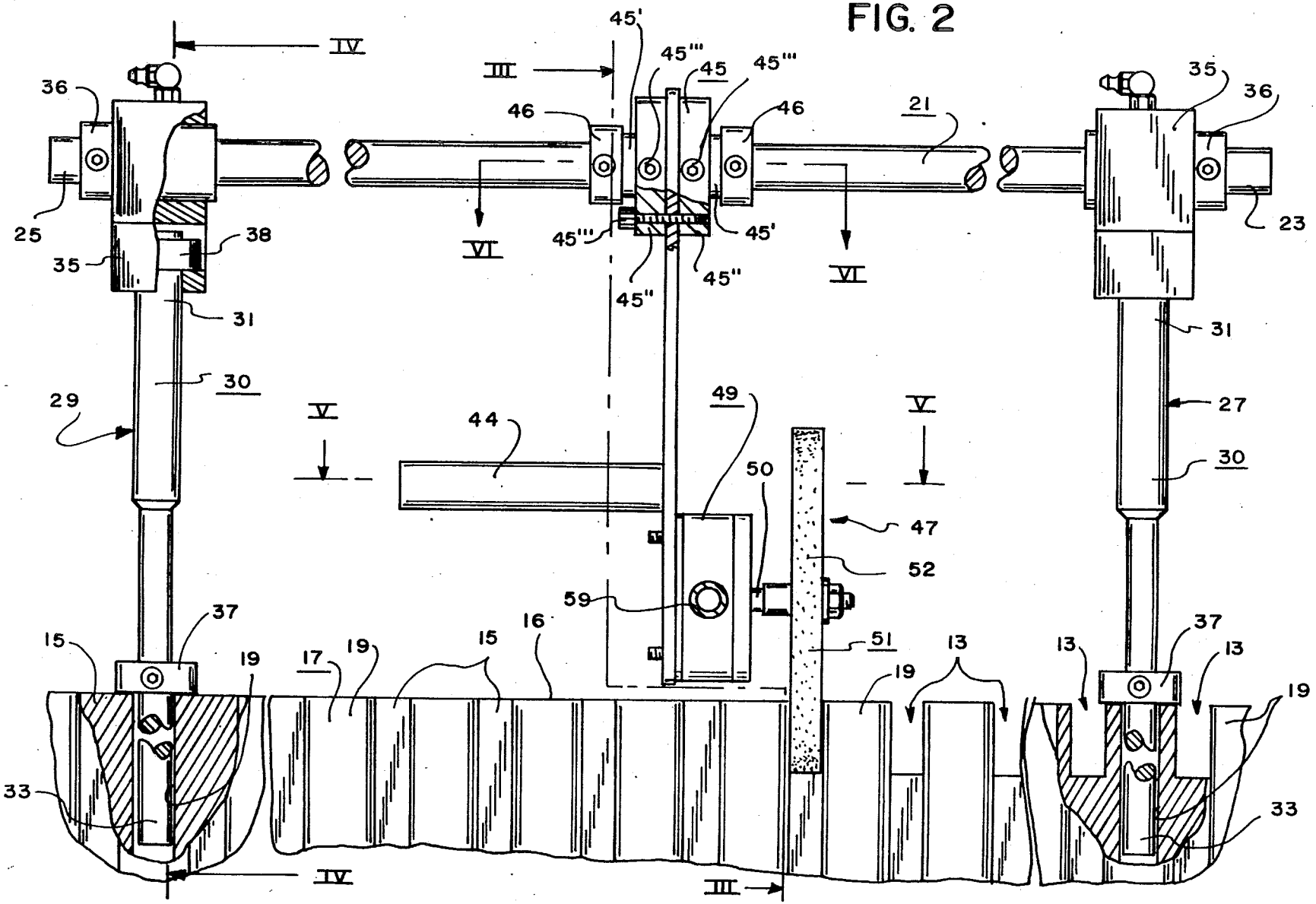
FIG. 2 is a front elevational view of a portion of the slitting tool of the present invention shown associated with a portion of a membrane wall and with portions thereof broken away for clarity.

The tool 11 of the present invention is used to cut slits 13 into the ends of one or more web portions 15 of an end portion 16 of a membrane wall 17 comprised of a plurality of parallel, spaced boiler tubes 19 joined to one another by the web portions 15. The tool 11 includes a guide bar 21. The guide bar 21 preferably consists of an elongated metal shaft having a first end 23 and a second end 25. While the length of the guide bar 21 may vary, it is preferred that the distance between the first and second ends 23, 25 of the guide bar 21 to be sufficient to extend over a plurality of web portions 15 for reasons which will hereinafter become apparent.

The tool 11 includes securing means for securing the guide bar 21 to the membrane wall 17 at a location above the end portion 16 of the membrane wall 17. The securing means preferably includes a first securing member 27 for being attached to the first end 23 of the guide bar 21 and a second securing member 29 for being attached to the second end 25 of the guide bar 21. Each securing member 27, 29 may consist of an elongated metal shaft 30, having a first end 31 and a second end 33. The first end 31 of each securing member 27, 29 may be attached to the respective ends of the guide bar 21 in various manners now apparent to those skilled in the art. Preferably, a bearing member 35 is fixedly secured to the first end 31 of each shaft 30 with the guide bar 21 extending through the bearing members 35 to selectively allow the securing members 27, 29 to be moved toward and away from one another on the guide bar 21 for reasons which will hereinafter become apparent. Movable collar/screw assemblies 36 may be provided at each bearing member 35 to limit longitudinal movement thereof. Each securing member 27, 29 is preferably provided with a movable collar/screw assembly 37 positioned intermediate the first and second ends 31, 33 of the shafts 30 thereof for reasons which will hereinafter become apparent. The second end 33 of each shaft 30 may be secured to the membrane wall 17 by merely being inserted into the end of a boiler tube 19 (see FIG. 1). The specific size and shape of each shaft 30 may vary depending on the size and shape of the bore in each boiler tube 19, etc. The shafts 30 are preferably removably attached to the guide bar 21 by removable collar/screw assemblies 38 to allow each securing member 27, 29 to be easily replaced with another securing member of a different size, etc. for reasons which will hereinafter become apparent. The spaced securing members 27, 29 allow the guide bar 21 to be secured to spaced first and second portions of the end portion 16 of the membrane wall 17 respectively as will now be apparent to those skilled in the art.

Figure 3:
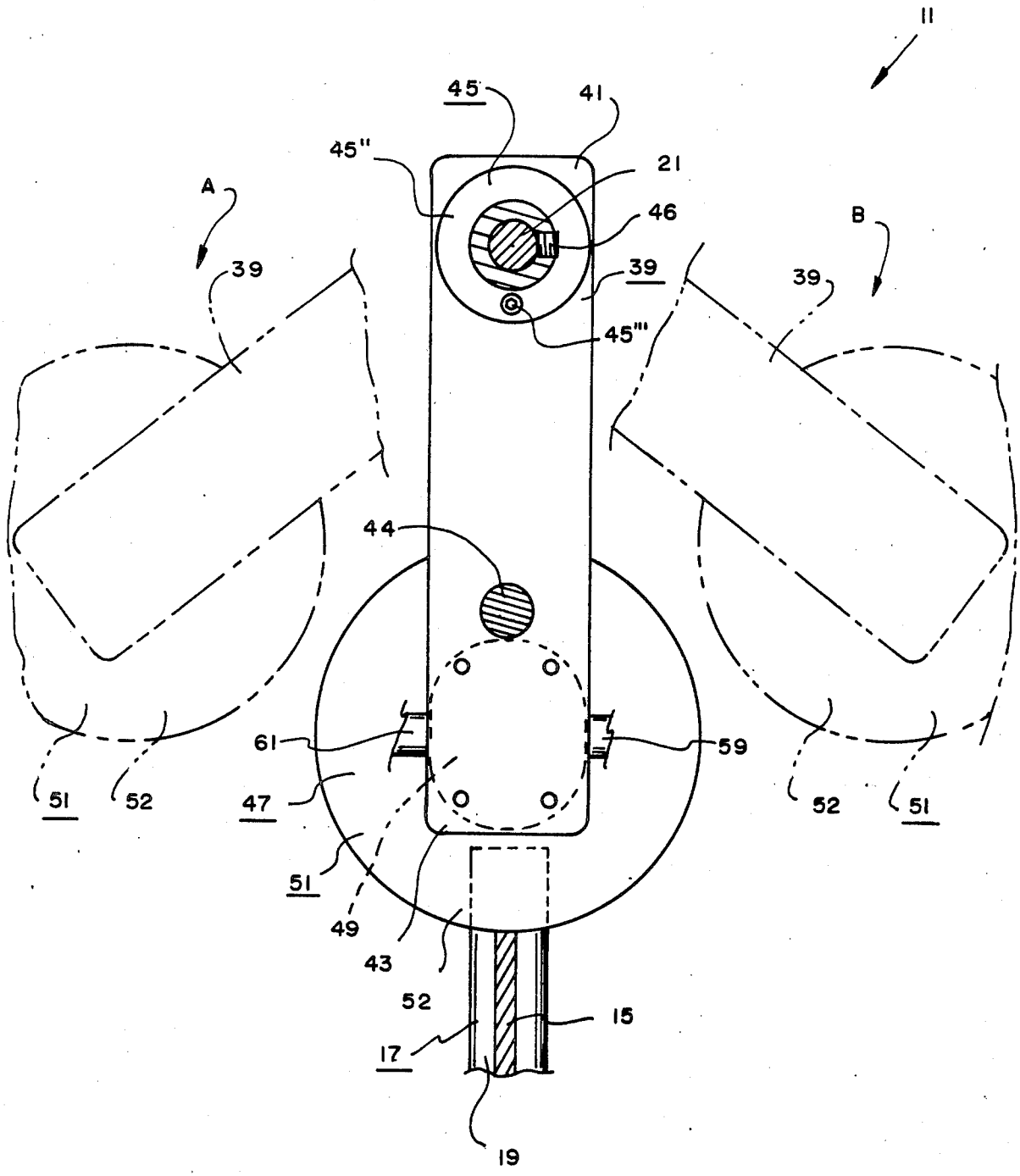
FIG. 3 is a sectional view substantially as taken on line III—III of FIG. 2 showing a portion thereof in moved positions in broken lines.
Figure 4:
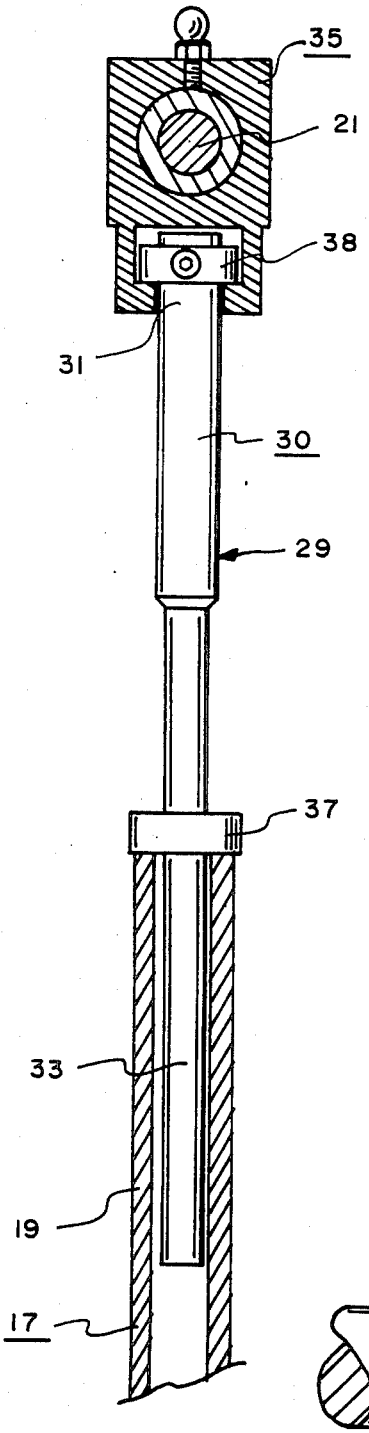
FIG. 4 is a sectional view substantially as taken on line IV—IV of FIG. 2.
Figure 5:
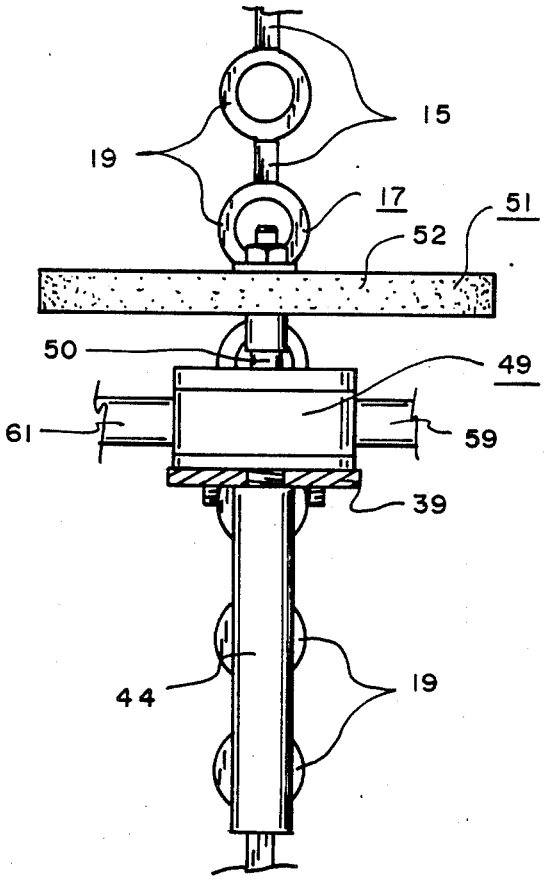
FIG. 5 is a sectional view substantially as taken on line V—V of FIG. 2.
Figure 6:
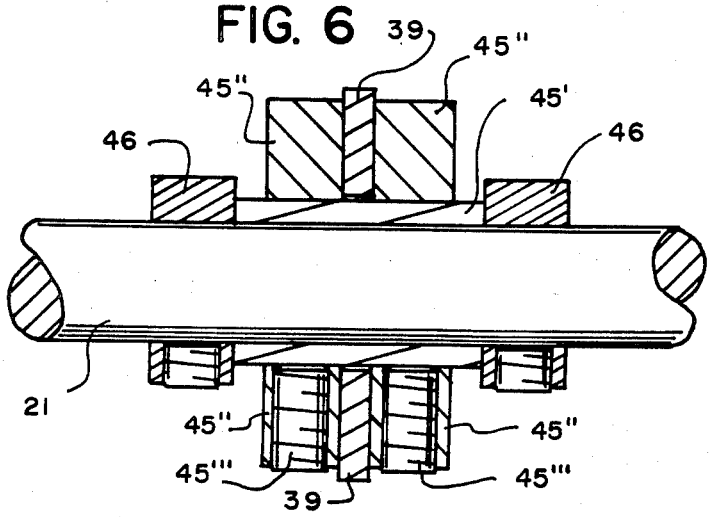
FIG. 6 is a sectional view substantially as taken on line VI—VI of FIG. 2.

The tool 11 includes a swing arm 39 having a first end 41 attached to the guide bar 21 and having a second end 43 swingable between, in general, a first position as indicated at A in FIG. 3 and a second position as indicated at B in FIG. 3. A handle 44 is preferably attached to the swing arm 39 to allow it to be easily moved between the first and second positions, etc. A bearing member 45 is preferably secured to the first end 41 of the swing arm 39 for swingably attaching the swing arm 39 relative to the guide bar 21. The bearing member 45 may be of any typical construction which will allow the swing arm 39 to pivot relative to the guide bar 21. Thus, the bearing member 45 may include a brass sleeve 45' for surrounding the guide bar 21 and a body 45'' attached to the sleeve 45' and to the first end 41 of the swing arm 39 by screws 45''' or the like. The bearing member 45 preferably allows the swing arm 39 to be moved along the length of the guide bar 21 for reasons which will hereinafter become apparent to those skilled in the art. Movable collar/screw assemblies 46 may be provided to secure the bearing member 45 and swing arm 39 in a specific position along the length of the guide bar 21.

The tool 11 includes a cutting means 47 attached to the second end 43 of the swing arm 39 for cutting a slit 13 into at least one of the web portions 15 of the membrane wall 17 when the swing arm 39 is moved between the first and second positions. The cutting means 47 preferably includes a motor member 49 for being attached to the second end 43 of the swing arm, and having an output shaft 50, and preferably includes a grinding wheel means 51 for being coupled to the output shaft 50 of the motor member 49 for being rotated by the motor member 49 and for cutting a slit 13 into a web portion 15 of the membrane wall 17 when the swing arm 39 is moved between the first and second position. The motor member 49 may be of any typical construction well known to those skilled in the art. The motor member 49 is preferably hydraulically activated for rotating the grinding wheel means 51 at a speed of at least 3600 revolutions per minute. While the specific qualities of the motor member 49 may vary, it is preferred that the motor member 49 has a 10 horse power output and has the ability to rotate the grinding wheel means 51 at an optimum speed of 12,000 revolutions per minute. The grinding wheel means 51 may include a grinding wheel 52 of any typical construction capable of rotating at the optimum speed and of cutting the metal the membrane wall 17 is constructed of, etc. as will now be apparent to those skilled in the art, and appropriate coupling structure for coupling the grinding wheel 52 to the output shaft 50 of the motor member 49. The thickness of the grinding wheel 52 may vary depending on the width of the slits 13 desired to cut into the web portions 15, etc. A typical guard (not shown) may be provided over a portion of the grinding wheel 52 for the safety of the operator of the tool 11, etc. as will now be apparent to those skilled in the art.

The tool 11 preferably includes a portable hydraulic drive means for activating the motor member 49. The drive means 53 preferably includes a drive motor 55 which may consist of a typical electric motor or the like, a reservoir 57 of hydraulic fluid, a hydraulic fluid feed line 59 for extending from the reservoir 57 to the motor member 49, a hydraulic fluid return line 61 for extending from the motor member 49 to the reservoir 57, and a hydraulic pump 63 of any typical construction well known to those skilled in the art for being coupled to the reservoir 57 and to the drive motor 55 for being driven by the drive motor 55 to pump hydraulic fluid from the reservoir 57 through the hydraulic fluid feed line 59 to the motor member 49 causing the output shaft 50 of the motor member 49 to rotate. The hydraulic fluid pumped to the motor member 49 will then return to the reservoir 57 through the hydraulic fluid return line 61. The hydraulic fluid feed and return lines 59, 61 preferably consist of elongated, flexible rubber hoses or the like. The hydraulic drive means 53 may include a radiator means 65 of any typical construction well known to those skilled in the art for cooling the hydraulic fluid. The hydraulic drive means 53 preferably includes a cart member 67 on which the drive motor 55, reservoir 57, hydraulic pump 63 and radiator means 65 are mounted. The cart member 67 preferably includes a rigid frame 69 constructed of metal or the like to which the drive motor 55, reservoir 57, hydraulic pump 63 and radiator means 65 are mounted, and wheels 71 rotatably mounted to the frame 69 for allowing the hydraulic drive means 53 to be easily moved.

To use tool 11 to cut slits 13 in the ends of one or more web portions 15 of a membrane wall 17, the second ends 33 of the first and second securing members 27, 29 are merely inserted into a pair of boiler tubes 19 on either side of the web portions 15 which are to be slitted. The securing members 27, 29 may be moved toward or away from one another on the guide bar 21 via the bearing member 35 to properly fit into the selected boiler tubes 19. The collar/screw assemblies 37 on the securing members 27, 29 will allow the securing members 27, 29 to be inserted into the selected boiler tubes 19 a sufficient distance so as to secure the tool 11 thereto and so as to position the guide bar 21 the desired distance above the ends of the web portions 15 to thereby control the depth of the slits 13. The swing arm 39 can then be slid toward the first or second end 23, 25 of the guide bar 21 via the bearing member 45 to position the grinding wheel means 51 directly over one of the web portions 15 to be slitted. With the hydraulic drive means 53 coupled to the motor member 49 and activated, the swing arm 39 need only be moved between the first and second positions to quickly and accurately cut a slit 13 into the web portion 15. The swing arm 39 can then be slid on the guide bar 21 via the bearing member 45 to position the grinding wheel means 51 over another web portion 15 to be fitted to thereby allow a plurality of web portion 15 to be sequentially slitted without requiring the securing members 27, 29 to be moved, etc. It is estimated that the tool 11 of the present invention will allow a slit 13 to be accurately made in one end of a web portion 15 without danger of cutting into the adjacent tubes 19 in 15 to 20 seconds instead of the 15 to 20 minutes now required by the prior art means and methods. To use the tool 11 with a membrane wall 17 having boiler tubes 19 of a different internal diameter, etc., the specific securing members 27, 29 can be easily replaced via the collar/screw assemblies 38 with other securing members of a different size, etc.

Although the present invention has been described and illustrated with respect to a preferred embodiment thereof and a preferred use thereof, it is not to be so limited since changes and modifications can be made therein which are within the full intended scope of the invention.

I claim:

1. A tool for cutting a slit into at least one web portion of one end of a membrane wall, said tool comprising:

(a) a guide bar;

(b) securing means for securing said guide bar to said membrane wall at a location above said one end of said membrane wall;

(c) a swing arm having a first end attached to said guide bar and having a second end swingable between a first position and a second position; and (d) cutting means attached to said second end of said swing arm for cutting a slit into said at least one web portion of said membrane wall when said swing arm is moved between said first and second positions.

2. The tool of claim 1 in which said membrane wall includes a plurality of laterally spaced web portions, and in which said swing arm is laterally movable on said guide bar to allow said cutting means to be sequentially moved laterally with respect to said one end of said membrane wall for sequentially cutting a slit into each of said plurality of laterally spaced web portions.

3. The tool of claim 2 in which said membrane wall has spaced first and second portions; in which said guide bar has a first end and a second end; and in which said securing means includes a first securing member attached to said first end of said guide bar for securing said first end of said guide bar relative to said first portion of said membrane wall, and includes a second securing member attached to said second end of said guide bar for securing said second end of said guide bar relative to said second portion of said membrane wall.

4. The tool of claim 3 in which said membrane wall has a plurality of spaced elongated tube members; in which said first securing member includes an elongated shaft for being inserted into one of said tube members to secure said first end of said guide rod thereto; and in which said second securing member includes an elongated shaft for being inserted into another of said tube members to secure said second end of said guide rod thereto.

5. The tool of claim 1 in which cutting means includes a motor member attached to said second end of said swing arm and includes a grinding wheel means coupled to said motor member for being rotated by said motor member at a speed of at least 3600 revolutions per minute and for cutting a slit into the web portion of said membrane wall when said swing arm is moved between said first and second positions.

6. The tool of claim 5 in which said motor member is hydraulic activated.

7. The tool of claim 6 in which is included a portable hydraulic drive means for activating said motor member.

* * * * *